United States Patent [19]

Peyre

[11] Patent Number: 4,865,678

[45] Date of Patent: Sep. 12, 1989

[54] LABEL FRANKING MACHINE SUITABLE FOR SELECTIVELY OUTPUTTING PRINTED LABELS WHICH ARE DRY OR WET

[75] Inventor: Jacques Peyre, Paris, France

[73] Assignee: Societe Anonyme dite: SMH Alcatel, Paris, France

[21] Appl. No.: 211,506

[22] Filed: Jun. 24, 1988

[30] Foreign Application Priority Data

Jun. 30, 1987 [FR] France ..... 87 09217

[51] Int. Cl.[4] ..... B65C 11/04; B43M 13/00

[52] U.S. Cl. ..... 156/356; 156/357; 156/442

[58] Field of Search ..... 156/356, 357, 442; 118/677; 83/242

[56] References Cited

U.S. PATENT DOCUMENTS 1,427,136 8/1922 Thun ..... 156/356
3,772,123 11/1973 Clark et al. ..... 156/357

FOREIGN PATENT DOCUMENTS 180410 6/1969 Fed. Rep. of Germany .
1592187 6/1970 France .
2238329 2/1975 France .
545119 5/1942 United Kingdom .

*Primary Examiner*—Michael W. Ball
*Assistant Examiner*—Jeff H. Aftergut
*Attorney, Agent, or Firm*—Sughrue, Mion, Zinn, Macpeak & Seas

[57] ABSTRACT

The machine of franking labels includes means (5, 7) for ejecting printed labels to a dry label outlet (8), a switching flap (12) for switching labels towards a second outlet for wet labels (9), said flap being mounted to pivot on the axis of pressure wheels (7) belonging to the ejector means, and a moistening roll (23) mounted between the ejector means and the second outlet and driven at a speed greater than that of the ejector means in order to receive and wipe the labels which are deflected towards the second outlet, said labels engaging the moistening roll beneath a separator plate (10) between the outlets.

6 Claims, 1 Drawing Sheet

LABEL FRANKING MACHINE SUITABLE FOR SELECTIVELY OUTPUTTING PRINTED LABELS WHICH ARE DRY OR WET

The present invention relates to a device for selectively wetting printed labels, thereby enabling printed labels which are wet or which are dry to be output at will. Such a device is intended, in particular, for fitting to a label franking machine such that, after being printed, the labels are either dispensed moistened ready for being immediately applied and stuck to the corresponding letter or parcel, or else they are dispensed dry for use subsequently.

BACKGROUND OF THE INVENTION

Automatic postage handling installations are known which include devices for receiving "stuffed" envelopes and for closing them immediately prior to franking. In such installations, the envelope closing devices receive the envelopes one-by-one with their flaps open, and they moisten the gummed portion of each envelope flap prior to folding it down against the body of the envelope.

The flaps are moistened by pressing them against a moistening member while successive envelopes move under drive imparted by means which act essentially on the bodies of the envelopes. In such devices, the moistening member may be constituted by an endless belt, a wick, or a rotary drum for transferring moistening liquid from a tank in which a portion of the moistening member is wetted. While moistening liquid is being transferred, the flap is kept pressed against the moistening member.

Such devices cannot be used for wetting printed labels whose glue-coated faces must be completely and uniformly wetted while their printed faces must be protected from receiving any moisture while each label advances over a moistening member.

The object of the present invention is to provide a device for selectively wetting labels that have been printed in a franking machine, said device being readily adaptable to the franking machine and providing no risk of spoiling the printing which has just been performed.

SUMMARY OF THE INVENTION

The present invention provides a label franking machine suitable for selectively outputting printed labels which are dry or wet, the machine comprising a print drum, a pressure roll associated with the drum, means for ejecting said printed labels, and means for moistening printed labels which are desired wet, the machine further comprising a switching flap associated with said ejector means and controlled to move between an "up" first stable position in which it has no effect on said labels which are then output via a first outlet for dry labels, and a "down" second stable position in which it deflects labels towards a second outlet for wet labels, said moistening roll being fixed in a position between said ejector means and said second outlet, with the direction of said flap in its down position interferring with said moistening roll, said roll being driven to develop a speed which is greater than the speed imparted by said ejector means.

A separation plate is advantageously mounted at a distance from said ejection means and serves to delimit said dry and wet label outlets on either side of itself, which distance is shorter than the length of the labels.

Preferably, said flap is fixed to a shaft carrying the idler counter-wheels of the ejection means and is made to pivot therewith under the control of a motor coupled to said shaft by a crank-and-lever system.

Further, said flap may include a bend substantially level with the separator plate, defining an end tab on the flap enabling the flap to bear against the separator plate when the flap is in its down position.

BRIEF DESCRIPTION OF THE DRAWINGS

An embodiment of the invention is described by way of example with reference to the accompanying drawings, in which.

MORE DETAILED DESCRIPTION

Figure 1:
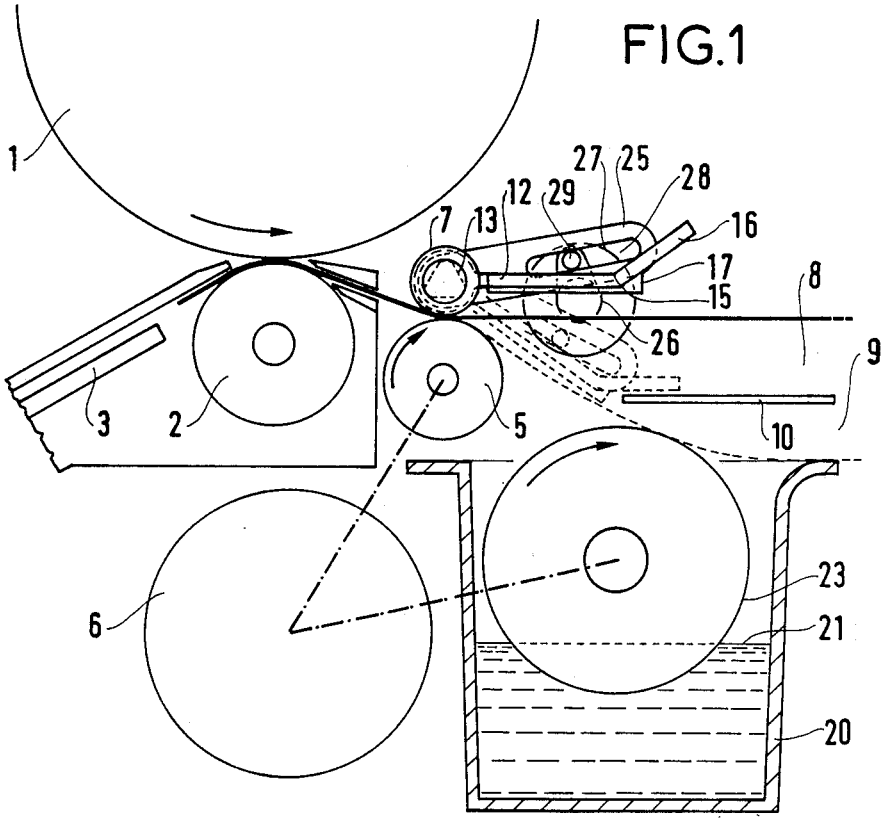
FIG. 1 is a diagrammatic view of a machine for franking labels and fitted with a device in accordance with the invention for selectively wetting printed labels.
Figure 2:
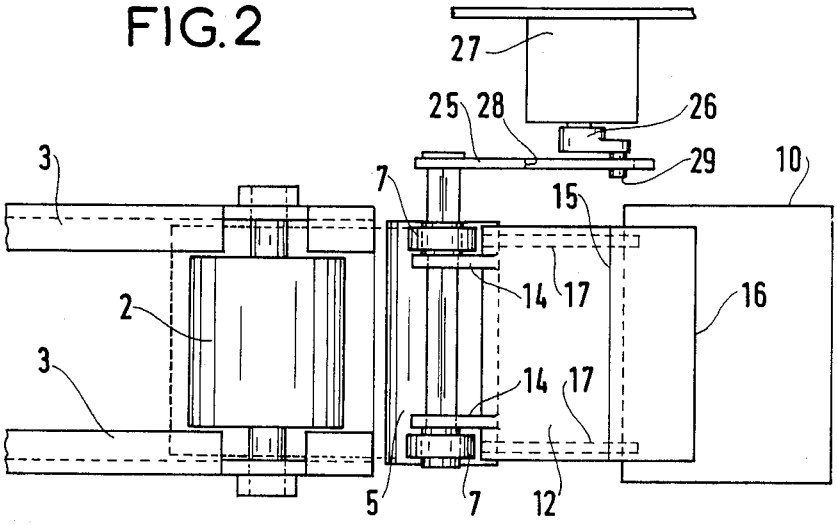
FIG. 2 is a diagrammatic plan view of FIG. 1.

In FIGS. 1 and 2, the label franking machine is represented merely by a print drum 1 and a pressure counter roll 2.

A chute 3 guides and presents successive labels to be printed so that they pass between the print drum 1 and its counter roll 2.

Such labels to be prited are taken from a continuous tape, advantageously in the form of "short" labels or "long" labels, as required, and they are driven along the chute 3 up to the print drum 1 and its counter roll 2. The means for cutting off various lengths of label and for driving the tape and the labels lie outside the scope of the present invention and are therefore not described. However, they may be as described in French patent application No. FR-85 06266 or in French patent application No. FR-87 07912, both in the name of the present Applicant, or they may correspond to various other known dispositions.

The chute 3 leaves the labels free for printing where they arrive between the print drum 1 and its counter roll 2. The end of the chute 3 extends slightly downstream from the print drum and its counter roll. Immediately downstream therefrom it provides initial guidance for the printed labels to ensure that they engage between an ejection drive roll 5 coupled to a motor 6 and a pair of associated pressure idler wheels 7, from which the labels are delivered dry via a first outlet 8 or wet via a second outlet 9.

These two outlets which depend on whether it is desired for the printed labels to be dry or wet are defined on either side of a separator plate 10.

The plate 10 is substantially horizontal and is mounted at a distance from the zone where the labels are held between the ejector roll 5 and its counter wheels 7 which is shorter than the length of the short labels. The printed labels, as guided through the end of the chute, are lightly curved between the ejector roll and its counter wheels so as to have a natural ejection path leading to the outlet 8.

A switching flap 12 is mounted above the ejector roll 5 and the separator plate 10 and extends substantially between them. It is carried by the same shaft 13 as the two counter wheels 7. These two counter wheels are mounted free to rotate relative to the shaft and they are spaced apart from each other so that they hold successive labels against the ejector roll by applying pressure to the long edges of the labels while avoiding any contact with the printed portions thereof.

In contrast, the switching flap 12 is constrained to rotate with the shaft 13. It has two tabs 14 which come between the two counter wheels 7 and which connect it to the shaft 13. For this purpose, the shaft 13 is advantageously triangular in section. The switching flap 12 is thus pivotally mounted about the same axis as the counter wheels 7 and pivots under the effect of small amplitude rotation of the shaft 13 in alternating opposite directions between two possible limit positions.

In FIG. 1, the switching flap 12 is shown in solid lines in one of its two limit positions referred to as its "up" position, and in which it extends generally parallel to the separator plate, being horizontal and at a considerable distance from the plate. It is shown in dashed lines in its other limit position, referred to as its "down" position, and in which it extends from the shaft 13 and bears against the end of the separator plate 10.

The end portion of the switching flap has a bend 15. The distance between the bend 15 and the shaft 13 is substantially equal to the distance between the shaft 13 and the separator plate 10. The bend changes the overall direction of the flap through an angle corresponding to the angle between its up and down positions. The end portion downstream from the bend is given reference 16 and constitutes a tab enabling the flap to press against the separator plate when the flap is in the down position. This terminal portion extends towards the top of the machine when the flap is in its up position.

There are two ribs 17 on the bottom face of the flap 12, at least between the shaft 13 and the bend 15. These two ribs 17 lie substantially downstream from the two counter wheels 7. Like the counter wheels, they are provided to avoid any contact with the printed portion of the top face of the labels, in particular when the switching flap is in its down position, since the flap has substantially no effect on the labels when it is in its up position.

A water supply tank 20 is placed between the ejector roll 5 and the separator plate 10, and beneath them. The level 21 of the water in the tank is kept constant by any appropriate means (not shown). A horizontal axis label-moistening roll 23 is partially immersed in the water in the tank 20.

The axis of the roll 23 is substantially vertically beneath the innermost end of the separator plate 10 (with "inner" being relative to a machine in which the device is fitted). As shown, roll is mounted so that its periphery remains spaced-apart from the separator plate 10, thereby leaving a gap between the roll and the separator plate which is considerably greater than the thickness of the labels.

The roll 23 is rotated to develop a linear speed which is greater than the linear speed imparted by the ejector roll 5, and which is advantageously at least twice said speed. The moisteninng roll 23 is shown as being driven by the motor 6 which is coupled to the ejector roll 5, and has a larger diameter than the roll 5.

A lever 25 and crank 26 type system controlled by a micromotor 27 serves to position the switching flap 12 in one or other of its two positions depending on whether it is desired for the printed labels to be dry or moistened. The lever 25 extends laterally along the switching flap 12. One of its ends is coupled to the end of the shaft 13 in order to drive the shaft, and it has an oblong slot 28 extending towards its other end. The crank 26 is driven by the micromotor 27 and its crank pin 29 is received in the slot 28 in the lever. The lever is thus pivoted and transmits a small amplitude rotary motion to the shaft 13, thereby causing the switching flap 12 to pivot correspondingly between its up and down positions.

The micromotor 27 is controlled by a button (not shown) disposed so as to be easily accessible to an operator. A half turn of the micromotor shaft causes the switching flap to move from its current position to its other position.

When the switching flap 12 is in its up position, successively printed labels are ejected so as to leave directly and be delivered via outlet 8, and the switching flap 12 thus has no effect on them.

When the switching flap 12 is in its down position, it deflects the labels towards the moistening roll 23. Since this roll is disposed so that the direction of the switching flap when in its down position interferes with the roll, the labels deflected by the flap interfere with the moistening roll at a point slightly downstream from the highest point of its periphery. The labels are thus pressed against the roll without any external pressure being exerted on the printed faces of the labels and they are curved so as to direct them towards the outlet 9, where they may optionally also be guided by the edges of the tank. While contact is being made between each label and the roll 23, the speed of the moistening roll, which is considerably greater than the speed of the ejector roll, causes the ejector roll to wipe the glue-coated face of the label being delivered.

The motor 6 is stopped as soon as a wet or dry label has been delivered. It is started up again after the beginning of a print cycle for printing a new label by means of the print drum 1, with the print drum performing both the function of printing the label and the function of advancing it up to the ejector roll.

A logic circuit (not shown) including appropriate time delays starts and stops the motor 6 appropriately.

While labels that are desired wet are being moistened, their printed faces are not in contact with any holding or pressure part, since such a part does not exist in the machine. The printed faces are thus not smudged. Another result of this is that a franking machine equipped in this way does not require the parts of its moistening device to be cleaned or changed.

We claim:

1. A label franking machine suitable for selectively outputting printed labels which are dry or wet, the machine comprising a print drum, a pressure roll associated with the drum, means for ejecting said printed labels, and means for moistening printed labels which are desired wet, wherein the machine further comprises a switching flap associated with said ejector means and controlled to move between an "up" first stable position in which it has no effect on said labels which are then output via a first outlet for dry labels, and a "down" second stable position in which it deflects labels towards a second outlet for wet labels, and wherein said moistening roll is fixed in a position between said ejector means and said second outlet, with the direction of said flap in its down position interferring with said moistening roll, said roll being driven to develop a speed which is greater than the speed imparted by said ejector means.

2. A franking machine according to claim 1, further including a separator plate delimiting, on either side thereof, said outlets for dry and wet labels, which plate is mounted at a distance from said ejector means which is shorter than the length of the shortest labels.

3. A franking machine according to claim 2, wherein said ejector means are constituted by a drive roll and two idler pressure counter-wheels, and said switching flap is mounted, substantially at one of its edges, to the shaft of said counter-wheels so as to be pivotable between its up position in which it is at a distance from said separator plate and is substantially parallel thereto, and its down position in which its end opposite from the shaft of said counter-wheels comes substantially to bear against said separator plate.

4. A franking machine according to claim 3, wherein said switching flap is constrained to rotate with the shaft carrying the counter-wheels with the shaft being coupled to a motor by a crank and lever system.

5. A franking machine according to claim 2, wherein said switching flap has a bend substantially level with said separator plate, said bend changing the general direction of the flap through an angle corresponding to the angle between its two positions and delimiting an end tab enabling said flap to bear against said separator plate when the flap is in its down position.

6. A franking machine according to claim 1, wherein said switching flap has two ribs on its face facing said ejector means and the moistening roll, said ribs being substantially level with the longitudinal edges of the labels delivered by said ejector means.

* * * * *